US005186667A

United States Patent [19]

Wang

[11] Patent Number: 5,186,667

[45] Date of Patent: Feb. 16, 1993

[54] FLOATING HAMMOCK

[75] Inventor: Cheng-Chung Wang, Taipei, Taiwan

[73] Assignee: Team Worldwide Corporation, Taiwan

[21] Appl. No.: 754,005

[22] Filed: Sep. 3, 1991

[51] Int. Cl.[5] ..... B63C 9/08

[52] U.S. Cl. ..... 441/129; 114/345; 441/130; 441/40

[58] Field of Search ..... 5/449, 455; 441/35, 441/40, 125-132; 272/1 B

[56] References Cited

U.S. PATENT DOCUMENTS

| | | | |
|---|---|---|---|
| 1,329,687 | 2/1920 | Underwood | 441/129 |
| 4,905,332 | 3/1990 | Wang | 441/130 |
| 4,986,781 | 1/1991 | Smith | 441/130 |

*Primary Examiner*—Edwin L. Swinehart
*Attorney, Agent, or Firm*—Marks & Murase

[57] ABSTRACT

A floating hammock for a user to rest thereupon on the water of a swimming pool. The floating hammock comprises a sling for the user to lie his/her body thereupon; a headrest for the user to rest his/her head thereupon; a footrest for the user to rest his/her feet thereupon; and a pair of armrests for the user to rest his/her arms and hands thereupon. The headrest, the footrest, and the armrest are either inflatable or made of foam such that the floating hammock is capable of floating above the water. The user resting upon the floating hammock can immerse himself/herself further into the water by adjusting either the length of the armrests or that of the sling.

20 Claims, 9 Drawing Sheets

FLOATING HAMMOCK

BACKGROUND OF THE INVENTION

The present invention relates generally to a floating hammock for a user to rest thereupon on the water of a swimming pool.

Floating articles which can be used in a swimming pool for a person to rest thereupon on the water to enjoy the bath from the sunshine include floating mattresses and inflatable tubs, etc. To improve relaxation and enjoyment, users of such floating articles often wish to have a floating article which enable them to be immersed in the water while resting thereupon to take the sun bath. The aforementioned floating articles, do not satisfy these needs.

SUMMARY OF THE INVENTION

It is therefore a primary object of the present invention to provide a floating hammock which allows a user to rest thereupon to take a sun bath on the water of a swimming pool.

It is another object of the present invention to provide a floating hammock which is capable of allowing the user rested thereupon to be immersed into the water of the swimming pool.

In accordance with the foregoing objects, there is provided a floating hammock for a user to rest thereupon on the water of a swimming pool. The floating hammock comprises a sling for the user to lie thereon; a headrest for the user to rest his/her head thereon; a footrest for the user to rest his/her feet thereon; and a pair of armrests for the user to rest his/her hands thereon.

The headrest, the footrest, and the armrest are either inflatable or made of foam such that the floating hammock is capable of floating above the water.

The sling of the floating hammock should be longer than the armrest to allow the user immersed into the water. Various embodiments of the floating hammock with different structure are proposed to achieve this purpose.

BRIEF DESCRIPTION OF THE DRAWINGS

The present invention can be more fully understood by a reading to the subsequent detailed description of the preferred embodiments with references made to the accompanying figures, wherein.

DETAILED DESCRIPTION OF THE PREFERRED EMBODIMENTS

Figure 1:
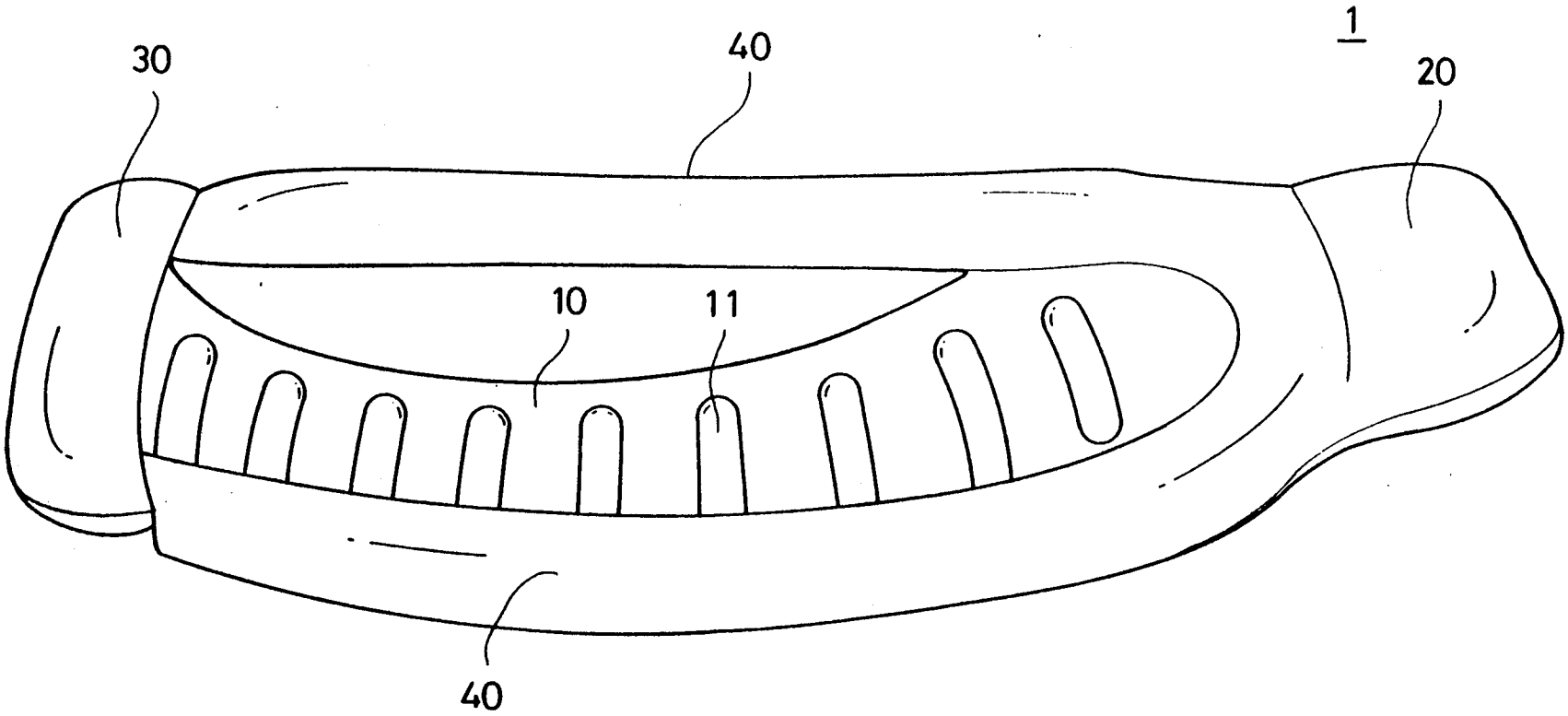
FIGS. 1 is a perspective view of a floating hammock according to the present invention.
Figure 2:
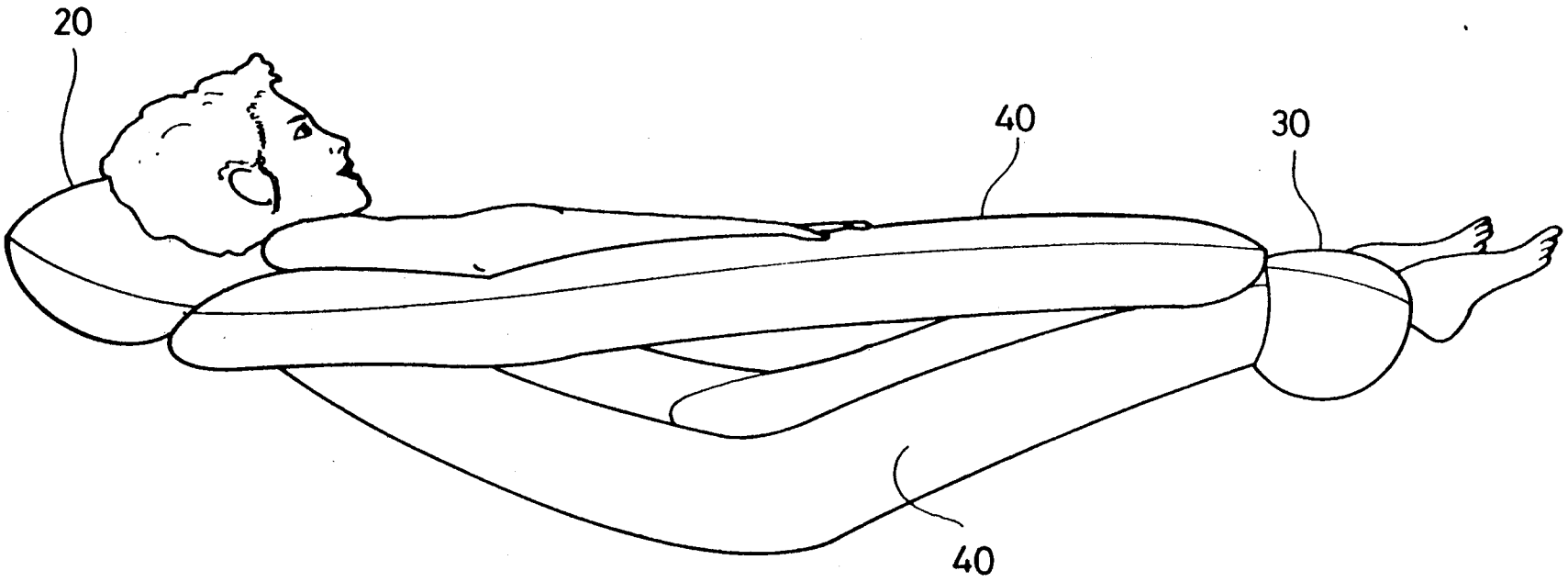
FIG. 2 is a side view of FIG. 1, showing a user resting upon the floating hammock.

Referring to FIGS. 1–2, there is shown a perspective view of an floating hammock provided according to the present invention. As shown in FIG. 2, a user can rest upon the floating hammock 1 for taking a sun bath on the water of a swimming pool with part of his/her body immersed into the water.

The floating hammock 1 according to the present invention consists essentially of a sling 10 for the user to lie his/her body thereupon; a headrest 20 for the user to rest his/her head thereupon; a footrest 30 for the user to rest his/her feet thereupon; and a pair of armrests 40 for the user to rest his/her arms and hands thereupon. The headrest 20, the footrest 30, and the armrests 40 are inflatable such that the floating hammock 1 is capable of floating on the water as the user lies upon the sling 10.

The sling 10 is provided with a plurality of air chambers 11 which allow the sling 10 to act like an air cushion to facilitate a soft and comfortable contact for the user. Moreover, the sling 10 in normal use is arched as shown in FIG. 2 such that the user lying thereupon can be immersed into the water. Therefore, the length of the sling 10 has to be longer than that of the armrest 40.

FIRST EMBODIMENT

Figure 3:
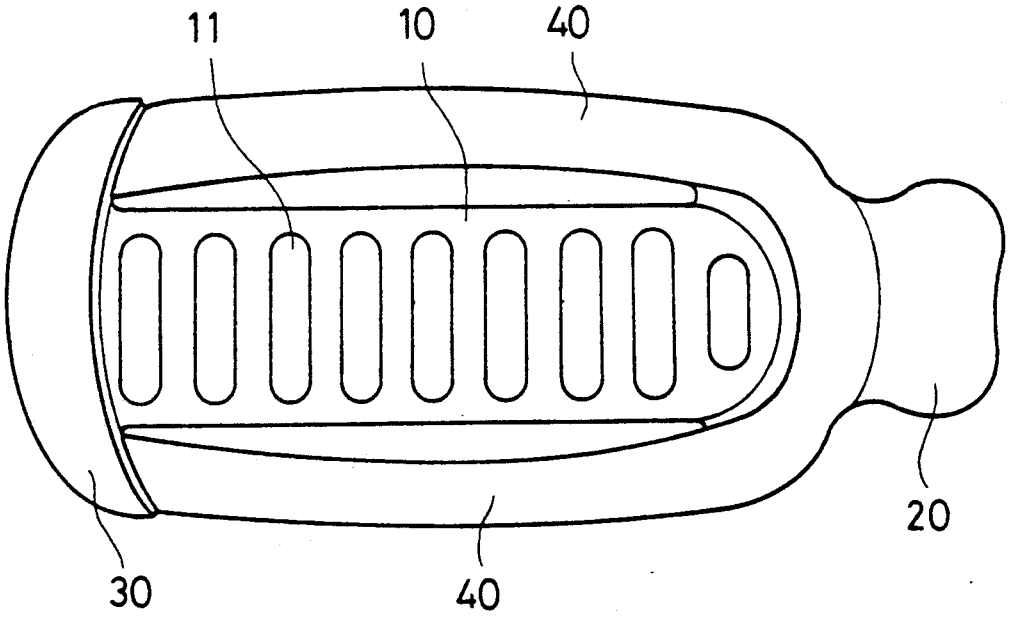
FIG. 3 is a top plan view of a first preferred embodiment of the floating hammock according to the present invention.
Figure 4:
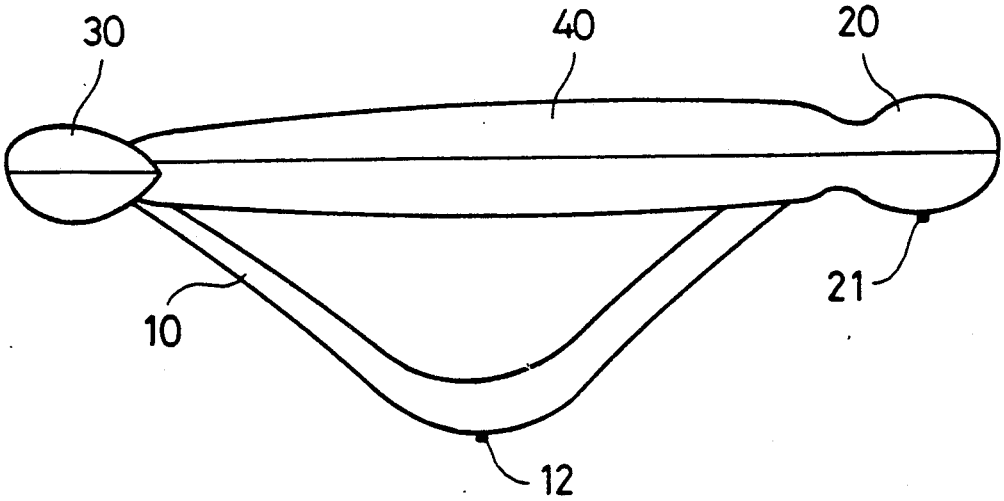
FIG. 4 is a side view of that shown in FIG. 3.

Referring to FIGS. 3–4, the floating hammock shown is a first preferred embodiment of the present invention. The sling 10, the headrest 20, the footrest 30, and the armrest 40 are integrally formed and therefore the length of the sling 10 and that of the armrest 40 are the same when the floating hammock is not inflated. In the first embodiment, a first air valve 21 is provided under the headrest 20 and air pumped into which can inflate the headrest 20, the armrest 40, and the footrest 30. A second air valve 12 is provided separately to inflate the air chambers 11 on the sling 10. As the armrest 40 is inflated, the length thereof is somewhat reduced, and as the headrest 20 and the footrest 30 are inflated, the two ends of the sling is somewhat pushed inwards; whereby the sling 10 is arched as shown in FIG. 4. The user lying on the sling 10 thereby can be immersed in the water.

If the user wishes to adjust the depth at which his/her body is immersed into the water, the user can inflate the air chambers 11 with the second air valve 12. As each of the air chambers 11 is inflated, the volume thereof is expanded and thus the length of the sling 10 became somewhat shortened and the sling becomes more buoyant, whereby the user is less immersed into the water. On the contrary, as each of the air chambers is deflated, the volume thereof is reduced and thus the sling 10 is somewhat elongated and sinks more deeply into the water, such that the user lying on the sling 10 is also more deeply immersed.

SECOND EMBODIMENT

Figure 5:
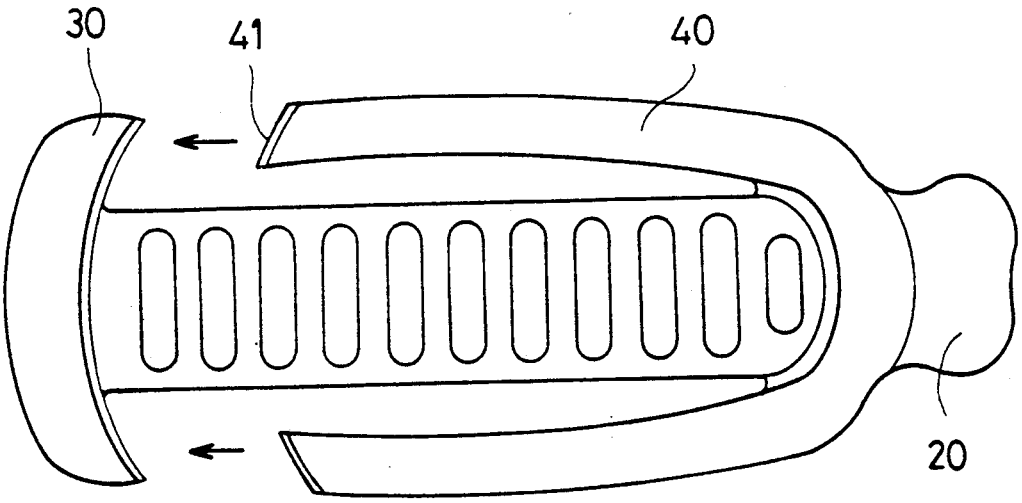
FIG. 5 is a top plan view of a second preferred embodiment of the present invention, showing how the sling is made longer than the armrest.
Figure 6:
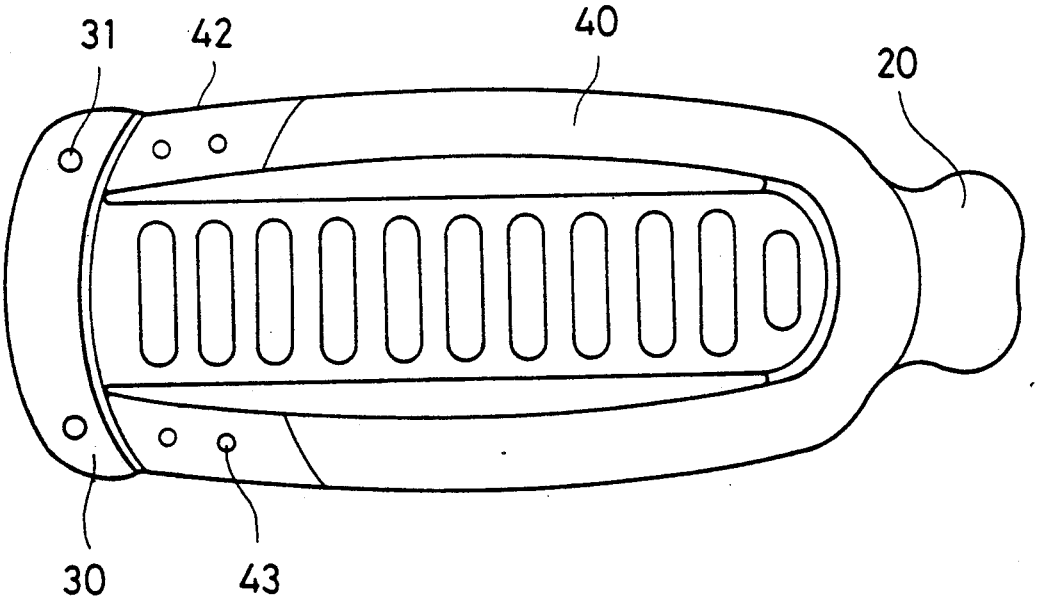
FIG. 6 is a top plan view of a third preferred embodiment of the floating hammock, showing particularly how the distance between the footrest and the headrest can be adjusted.

Referring to FIG. 5, in a second embodiment of the floating hammock the length of each of the armrests 40 is designed to be shorter than that of the sling 10. Therefore, as the floating hammock is formed, one end of the armrest 40 is integrally connected to the headrest 20 and the other end 41 is a free end separated from the footrest 20. The ends 41 are later heat sealed to the footrest 30.

The above second embodiment required an additional heat-sealing step in the manufacture. However, the sling 10 in this second embodiment can be made relatively much longer than that of the first embodiment.

In the foregoing embodiment the lengths of the sling and the armrest are fixed. Other provisions can be devised to allow the user to adjust the depth at which he/she is immersed into the water. For this purpose, the length of the armrest 40 is made adjustable in a third preferred embodiment of the present invention.

THIRD EMBODIMENT

Figure 7:
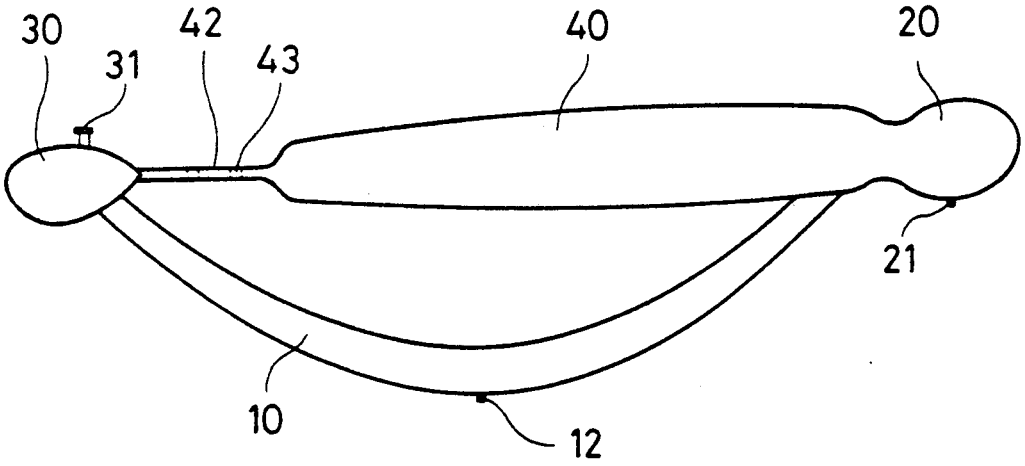
FIG. 7 is a side view of FIG. 6.
Figure 8:
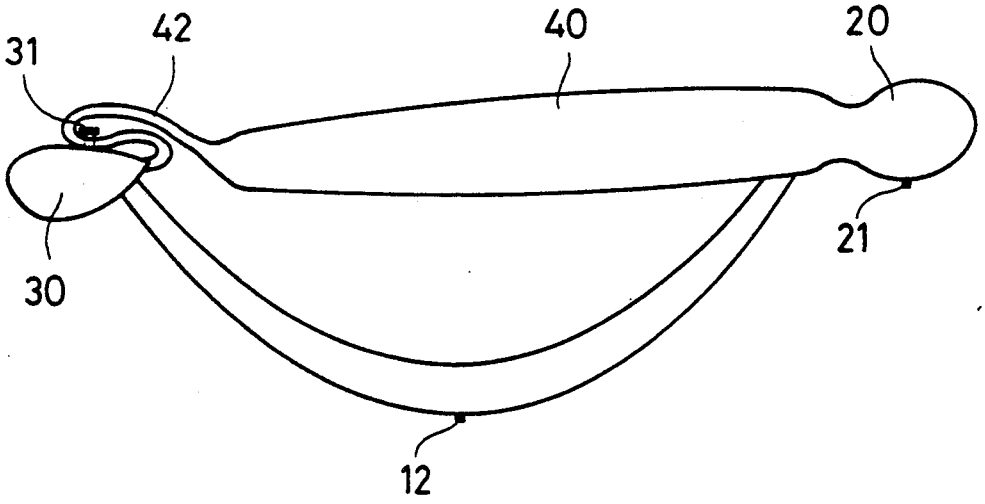
FIG. 8 is a same view as shown in FIG. 6 except the distance between the footrest and the headrest has been adjusted to be shorter.
Figure 9:
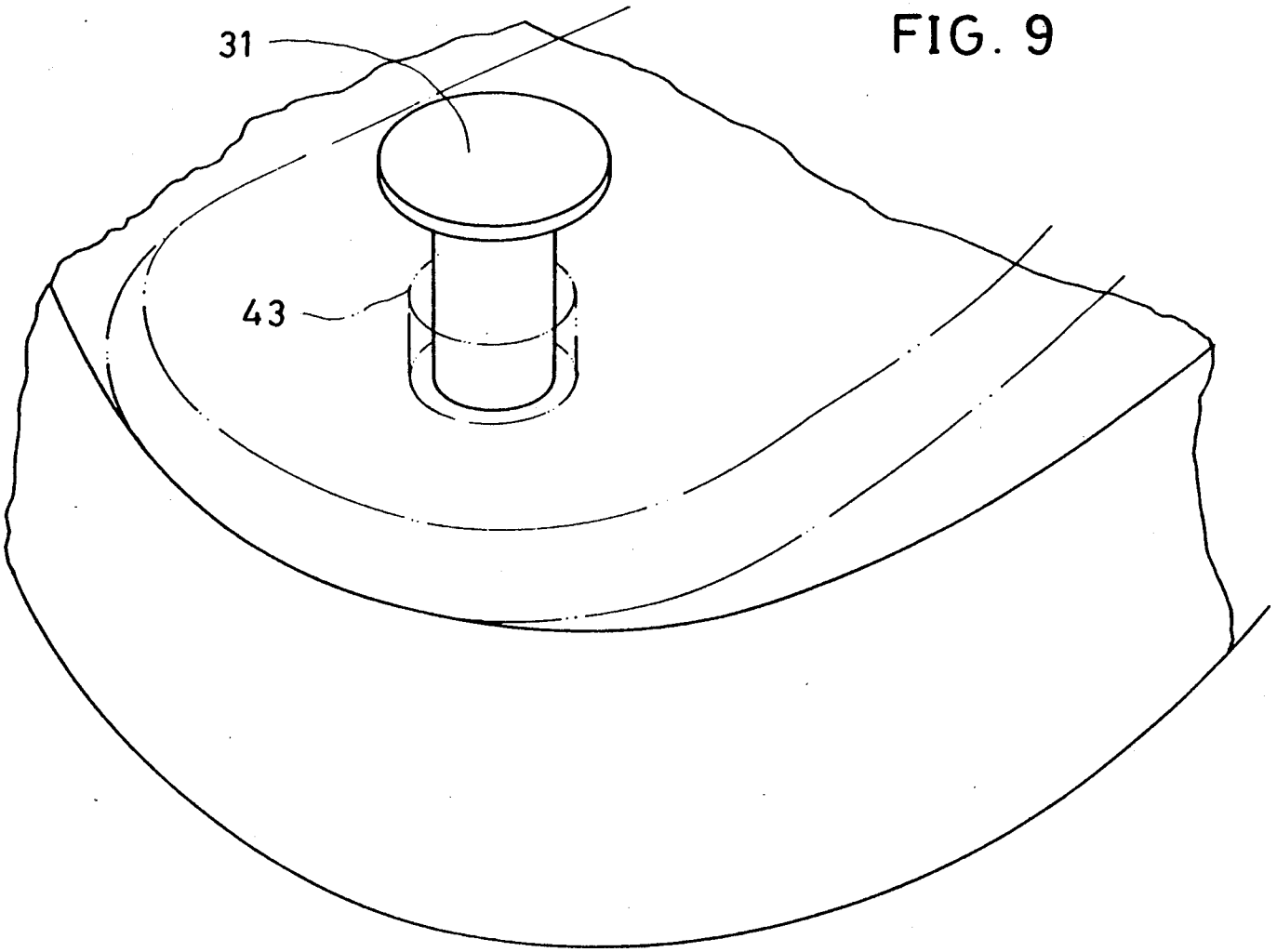
FIG. 9 is an enlarged view, showing how the T-shaped engaging means provided on the footrest is engaged with the holes provided on the armrests.

Referring to FIGS. 6–9, the length of the armrest 40 is made adjustable in the third preferred embodiment of the present invention in which a flat and non-inflatable segment 42 is provided between the footrest- 30 and each of the armrests 40. A plurality of holes 43 are provided on the flat segment 42 and a pair of T-shaped engaging means 31 are provided on the footrest 30. Each of the holes 43 is capable of being engaged with the T-shaped engaging means as shown in the enlarged view of FIG. 9. In this way, as shown in FIGS. 7–8, the distance between the footrest 30 and the headrest 20 is capable of being adjusted by engaging the T-shaped engaging means with different holes 43. As the distance between the footrest 30 and the headrest is decreased, the sling 10 is further arched such that the waist portion of the user is immersed deeper into the water.

This provision further allows users with different heights to adjust the distance between the footrest 30 and the headrest 20 so that each particular user can adjust the footrest 30 to a suitable position to rest his/her feet thereupon.

FOURTH EMBODIMENT

Figure 10:
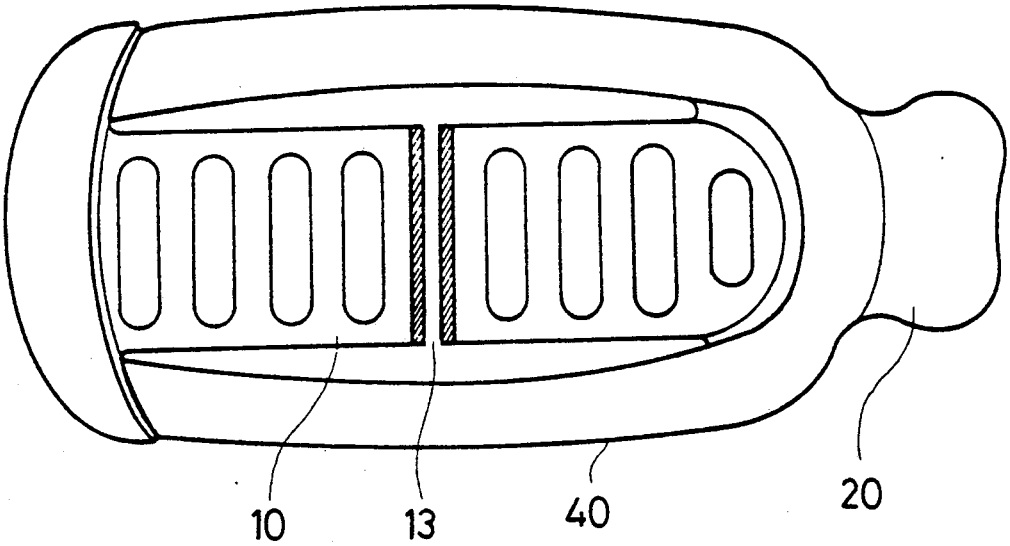
FIG. 10 is a top view of a fourth preferred embodiment, showing particularly the sling which is cut and divided into two separable portions.
Figure 11:
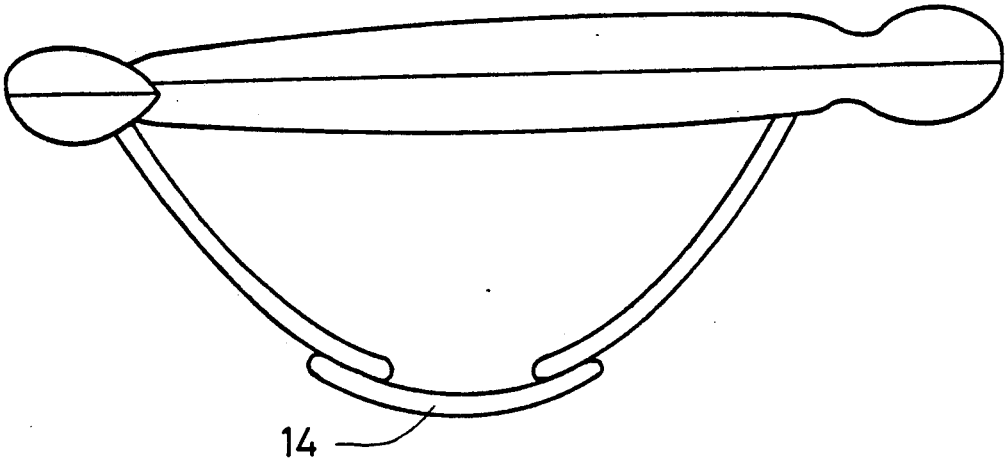
FIG. 11 is a side view of FIG. 10 except that an additional sling portion is heat sealed to the ends of the divided sling portions to elongate the sling.

Referring to FIGS. 10–11, another manufacture method can be utilized to make the sling 10 longer than the armrest sling 40. In a fourth embodiment, the center of the sling 10 of the first embodiment shown in FIG. 3, which is formed with a fixed lengths of sling and armrest, is cut and divided into two portions. Thereafter, a separate sling segment is attached and heat sealed thereto. A longer sling is thus formed.

FIFTH EMBODIMENT

Figure 12:
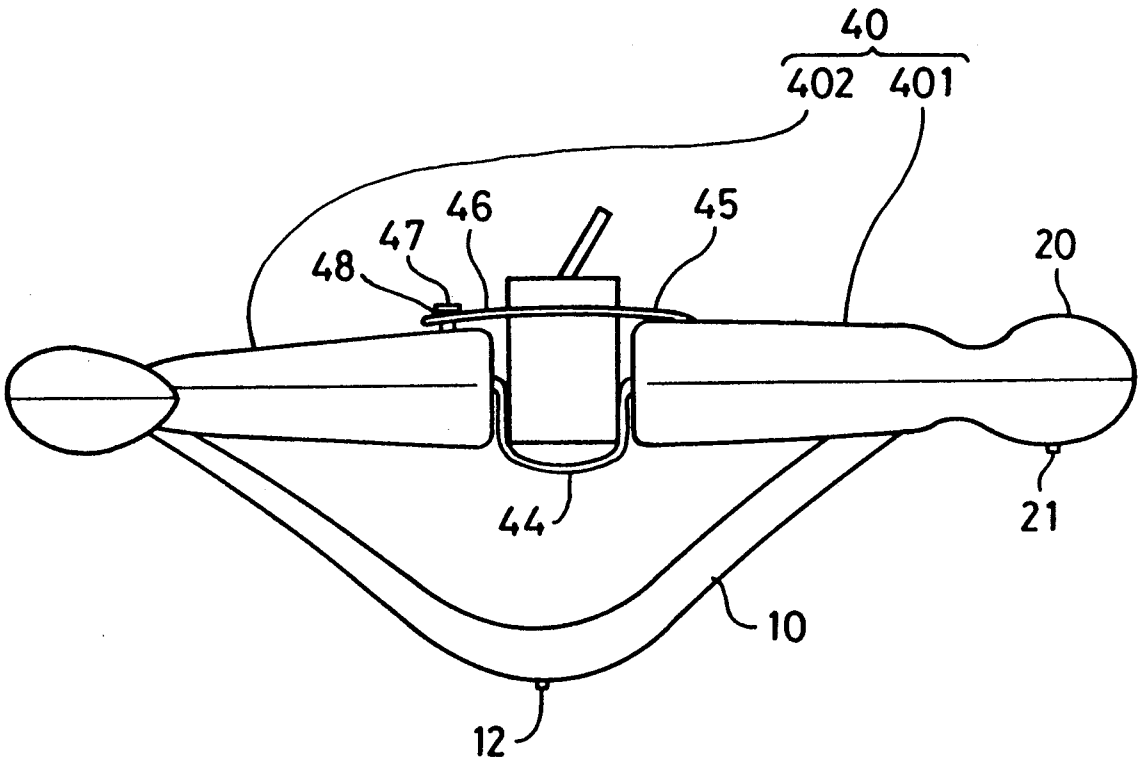
FIG. 12 is a side view of a fifth preferred embodiment, showing how the length of the armrests can be adjusted by another method.

Referring to FIG. 12 there is shown a fifth embodiment of the floating hammock in which the length of the armrest 40 is adjustable. In the fifth embodiment, a flat and non-inflatable first sheet segment 44 is provided near the center of the armrest 40 connecting two inflatable portions 401 and 402 of the armrest. A second sheet segment 45 is provided above the first sheet segment 44 with one end thereof connected to the portions 401. The second sheet segment 45 is shorter than the first sheet segment 44. A T-shaped engaging means 47 is provided on the portion 402 which is capable of engaging with a hole 48 provided on an appropriate portion of the second sheet segment 45. When engaged, the shorter second sheet segment 45 would bring the two portions 401 and 402 closer to each other such that the total length of the armrest 40 is reduced.

An opening 46 may further be provided on the second sheet segment 45 such that when the hole is engaged by the T-shaped engaging means 47, the opening 46 may act as a drink holder for holding a glass of cold drink.

SIXTH EMBODIMENT

Figure 13:
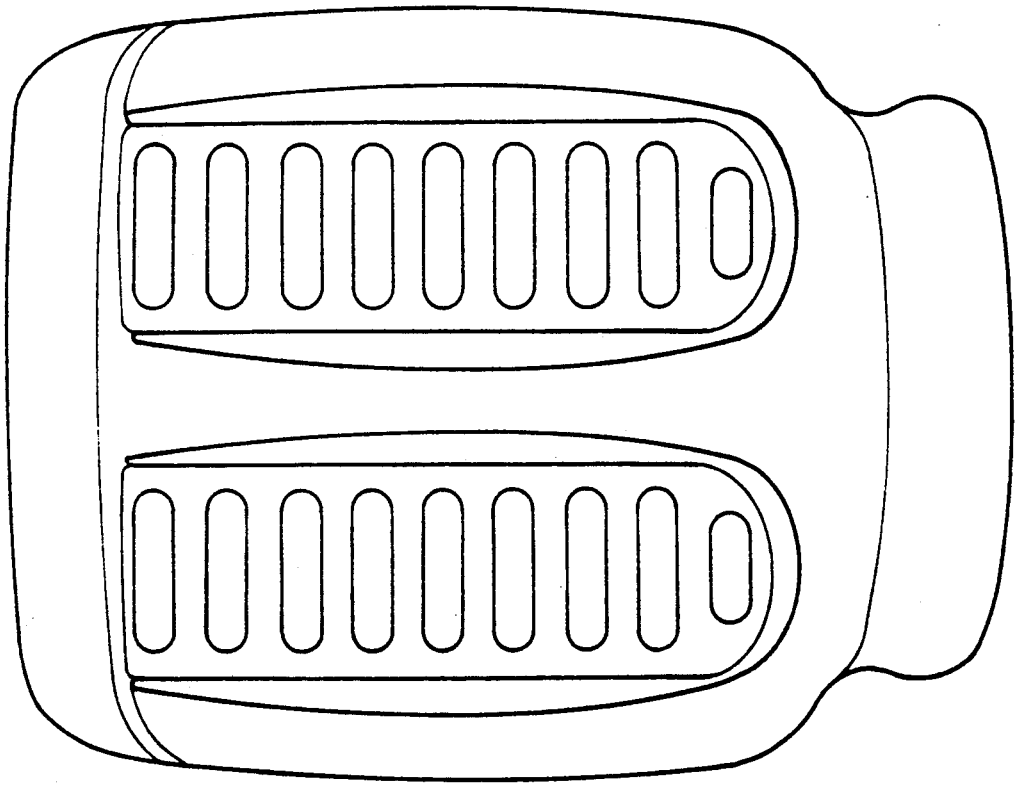
FIG. 13 is a top plan view of a sixth preferred embodiment of the present invention as a double floating hammock for a couple of users to rest thereupon.

Referring to FIG. 13, the floating hammock according to the present invention can also be made into a double floating hammock for a couple of users to rest thereupon. All the features describe heretofore for the first, the second, and the third preferred embodiment of the present invention can also be adapted to the double floating hammock.

Ergonomic design has been considered and provided to the sling 10 of the floating hammock so that the user resting thereupon will have a more pleasing and relaxed feeling. The floating hammock according to the present invention is also suitable for use as a water exercise platform. For example, the user can sit up and down on the sling 10 with his/her hands hold on to the armrest to exercise his/her body with a massaging effect from the water.

The floating hammock according to the present invention has been described hitherto with a number of exemplary preferred embodiments. However, it is to be understood that the scope of the present invention need not to be limited to the disclosed preferred embodiments. On the contrary, it is intended to cover various modifications and similar arrangements within the scope defined in the following appended claims and the scope of which should be accorded the broadest interpretation so as to encompass all such modifications and similar arrangements.

What is claimed is:

1. A floating hammock for a user to rest thereupon on the water of a pool, comprising:

a sling having two ends for the user to lie thereon;

a headrest connected to one end of said sling;

a footrest connected to the other end of said sling, said footrest comprising a first engaging means; and a pair of armrests having one end connected to said headrest and the other end connected to said footrest, said armrests being disposed near the two sides of said sling such that the user lying upon said sling may rest his/her hands thereupon and each said armrest comprising a non-inflatable segment having at least one second engaging means;

wherein said headrest, said footrest, and said armrest are capable of floating above the water; and said first engaging means and said second engaging means being capable of engaging with each other such that the length of said armrest can be adjusted to allow the user lying upon said sling to be further immersed into the water.

2. The floating hammock as claimed in claim 1, wherein said sling comprising a plurality of air chambers which act as air cushions for the user.

3. The floating hammock as claimed in claim 2, wherein said air chambers can be inflated to decrease the length of said sling or deflated to increase the length of said sling.

4. The floating hammock as claimed in claim 1, wherein said sling is made longer than said armrest.

5. The floating hammock as claimed in claim 1, wherein said armrest comprising:

a first portion and a second portion;

a first sheet segment connecting said first portion and said second portion; and a second sheet segment having a first end connected to said first portion and a second end, whereby the length of said armrest is capable of being shortened by connecting an appropriate portion of said second sheet segment to said second portion.

6. The floating hammock as claimed in claim 1, wherein said headrest, and said footrest are inflatable.

7. The floating hammock as claimed in claim 1, wherein said floating hammock is made of foam.

8. A floating hammock for a user to rest thereupon on the water of a pool, comprising:

a sling having two ends for the user to lie thereon;

a headrest connected to one end of said sling;

a footrest connected to the other end of said sling; and a pair of armrests having one end connected to said headrest and the other end connected to said footrest, said armrests being disposed near the two sides of said sling such that the user lying upon said sling may rest his/her hands thereupon each said armrest comprising:

a first portion and a second portion;

a first sheet segment connecting said first portion and said second portion; and a second sheet segment having a first end connected to said first portion and a second end, said second sheet segment having an opening thereon for holding drinks, whereby the length of said armrest is capable of being shortened by connecting an appropriate portion of said second sheet segment to said second portion;

wherein said headrest, said footrest, and said armrest are capable of floating above the water.

9. A one piece floating hammock for a user to rest thereupon on the water of a pool, comprising:

a sling portion for the user to lie thereon, said sling portion having two ends and two sides;

a headrest portion integrally connected to one end of said sling portion;

a footrest portion integrally connected to the other end of said sling portion;

a pair of armrest portions having a first end integrally connected to said headrest portion and a second end connected to said footrest portion, said armrest portions being disposed near the two sides of said sling portion such that the user lying upon said sling portion may rest his/her hands thereupon;

wherein said headrest portions; said footrest portions, and said armrest portions are capable of floating above the water.

10. The one-piece floating hammock of claim 9, wherein each of the armrest portions are shorter than the sling portion such that connection of the armrest portions to the footrest portions causes arching of the sling portion.

11. The one-piece floating hammock of claim 9, wherein the length of the armrest portion is adjustable.

12. The one-piece floating hammock of claim 11, wherein each armrest portion includes a flat non-inflatable segment having a plurality of holes formed therein;

and further comprising engaging means formed on the footrest portion for engaging at least one of the holes of each armrest portion so as to adjust the armrest portion.

13. The one-piece floating hammock of claim 9 wherein the sling portion is cut and divided into two sections adapted to be heat sealed to a separate sling segment to increase the length of the sling portion.

14. The one-piece floating hammock as claimed in claim 9, wherein said sling portion comprises a plurality of air chambers which act as air cushions for the user.

15. The one-piece floating hammock as claimed in claim 14, wherein said air chambers can be inflated to decrease the length of said sling portion or deflated to increase the length of said sling portion.

16. The one-piece floating hammock as claimed in claim 9, wherein;

said footrest portion comprising a first engaging means; and said armrest portion comprising a non-inflatable segment having at least one second engaging means;

said first engaging means and said second engaging means being capable of engaging with each other such that the length of said armrest portion can be adjusted to allow the user lying upon said sling portion to be further immersed into the water.

17. The one-piece floating hammock as claimed in claim 9, wherein said second sheet segment has an opening thereon which acts as a during holder.

18. The one-piece floating hammock as claimed in claim 9, wherein said headrest portion, said armrest portion, and said footrest portion are inflatable.

19. The one-piece floating hammock as claimed in claim 9, wherein said floating hammock is made of foam.

20. The one-piece floating hammock as claimed in claim 9, wherein each of the armrest portions are shorter than the sling portion and each armrest includes one end integrally connected to the headrest and another end free and supported from the headrest but adapted to be heat sealed thereto.

* * * * *